US005499646A

United States Patent [19]

Lee

[11] Patent Number: 5,499,646

[45] Date of Patent: Mar. 19, 1996

[54] FOLDABLE TENT

[76] Inventor: Woon Lee, 1-303 Keumkang Apartment, 625-8 Shimkokbon-dong, Sosa-ku, Buchon-shi, Kyounggi-do, Rep. of Korea

[21] Appl. No.: 261,114

[22] Filed: Jun. 14, 1994

[30] Foreign Application Priority Data

Jun. 14, 1993 [KR] Rep. of Korea ..... 93-10421

[51] Int. Cl.[6] ..... E04H 15/28; A45F 3/00

[52] U.S. Cl. ..... 135/121; 135/15.1; 135/16; 135/96; 135/99; 135/123; 135/126; 135/140

[58] Field of Search ..... 135/15.1, 16, 96, 135/99, 121, 123, 124, 126, 133, 135, 140, 142, 114, 28, 29, 39

[56] References Cited

U.S. PATENT DOCUMENTS

| | | | |
|---|---|---|---|
| 574,091 | 12/1896 | Irvine, Jr. | 135/16 X |
| 645,704 | 3/1900 | Downs | 135/16 X |
| 734,311 | 7/1903 | Ferroussat | 135/16 |
| 1,903,209 | 3/1933 | Butler | 135/16 |
| 2,221,366 | 11/1940 | Bisbing et al. | 135/16 |
| 2,258,196 | 10/1941 | Siers | 135/15.1 |
| 3,860,022 | 1/1975 | Arndt et al. | 135/96 X |
| 3,929,146 | 12/1975 | Maiken | 135/126 X |
| 4,202,363 | 5/1980 | Watts et al. | 135/126 X |
| 4,945,936 | 8/1990 | Surrendi | 135/126 X |
| 5,135,018 | 8/1992 | Anderson | 135/99 |

FOREIGN PATENT DOCUMENTS

| | | | |
|---|---|---|---|
| 0592317 | 5/1930 | Germany | 135/16 |
| 285649 | 1/1953 | Switzerland | 135/126 |
| 450887 | 7/1936 | United Kingdom | 135/126 |

*Primary Examiner*—Wynn E. Wood
*Attorney, Agent, or Firm*—Birch, Stewart, Kolasch & Birch

[57] ABSTRACT

A foldable tent is provided which achieves the desired stretch of a cloth tent body when fully pitched. The foldable tent includes a cylindrical center member comprising a top cylinder and a bottom cylinder detachably coupled to each other. A cylindrical slider having a notch on its inner surface is movably fitted over the center member. An elastic locking member is mounted in the to cylinder of the center member for locking the slider. The locking member has a locking projection snapping into the notch of the slider. A release mechanism for releasing the locking projection from the notch of the slider is received in the bottom cylinder. The tent framework further includes a plurality of ribs. Each the rib is hinged to a corresponding pipe frame and the slider at its opposed ends such that an angle formed between it and the top cylinder when pitching the tent is less than 90°. This foldable tent is easily pitched and struck regardless of tent size. The pipe frames can be easily repaired when they are damaged as a result of long time use.

10 Claims, 7 Drawing Sheets

FIG 8A
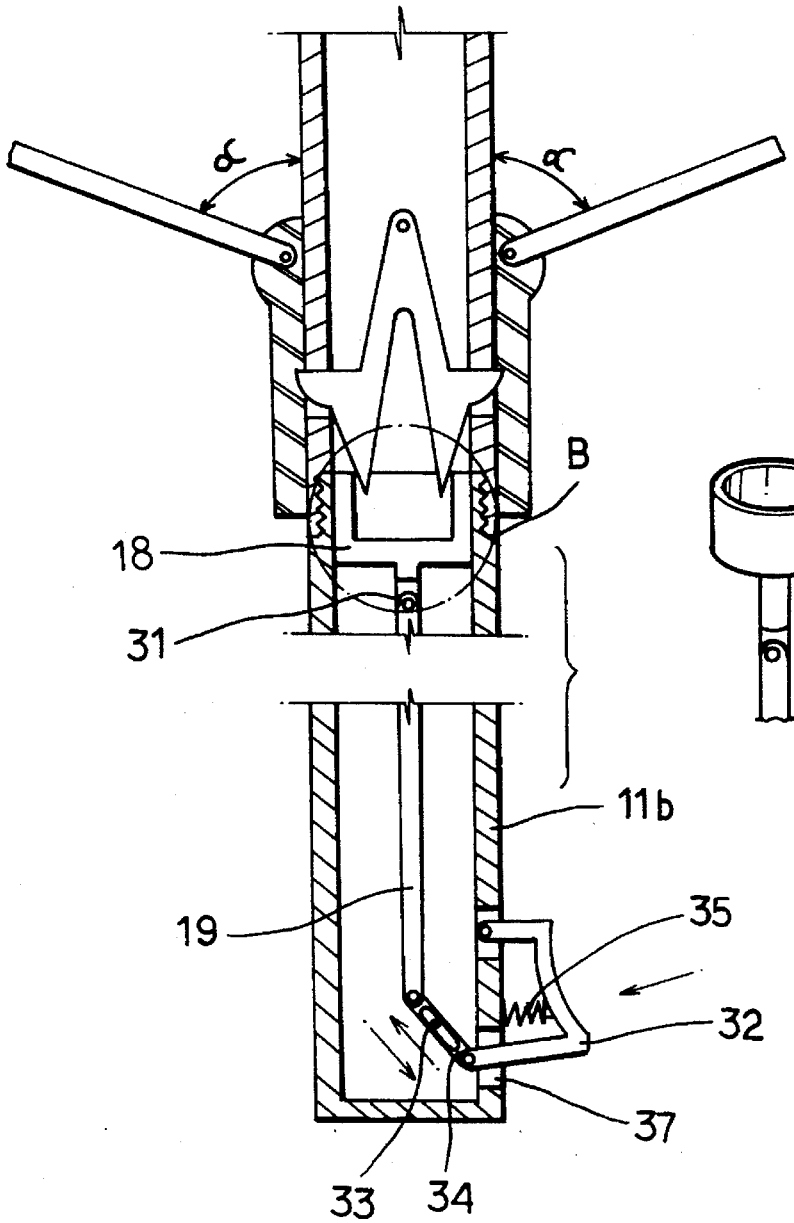
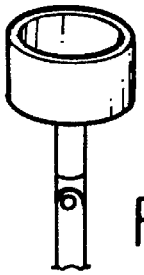
FIG. 8B

FOLDABLE TENT

BACKGROUND OF THE INVENTION

1. Field of the Invention

The present invention relates in general to umbrella type foldable tents and, more particularly, to an improved structure of such foldable tents for facilitating the pitching and the striking thereof.

2. Description of the Prior Art

With reference to FIG. 1, there is shown a conventional foldable tent which is disclosed in Korean Utility Model Publication No. 89-2477. The foldable tent is pitched or struck by extending or folding a plurality of pipe flames 1 connected to each other by a plurality of joints 2. When pitching the foldable tent, the user manually extends all the pipe frames 1 by strongly biasing the joints 2. However, as the tensile force of the cloth tent body becomes stronger in accordance with extending of the pipe frames 1, the user needs to exert all his strength when extending the last frame 1 or biasing the last joint 2. This makes the pitching of the foldable tent very difficult.

In order to facilitate the pitching of the above foldable tent, the pipe frames 1 are preferably made of an excellent flexible material. However, the above flexible material does not provide pipe frames with a good resilience, which frames should be used along with the foldable tent. That is, the pipe frames 1 made of the above flexible material do not achieve a desired stretch of the cloth tent body when the tent is in a pitched state. In addition, when striking the foldable tent, the user should bias the first joint while exerting all his strength exceed the tensile force of the tent body. This may cause breaking of the pipe frame 1 or of the joints 2.

Turning to FIG. 2, there is shown a conventional foldable tent which is disclosed in Korean Utility Model Publication No. 91-1106. When pitching this foldable tent, a center rope 3 is pulled down while gripping a center member 4 in the same manner as opening a conventional umbrella. Thus to move the center member 4 is moved upward until the top section of the member 4 is locked to a locking cap 6. When striking the tent, a release button 7 of the locking cap 6 is pushed so as to elastically separate the top section of the center member 4 from the locking cap 6.

In the above foldable dent of FIG. 2, a desired stretch of the pitched tent is achieved only when the foldable ribs 5 coupled to the center member 4 are nearly horizontally stretched, as shown at the dotted line of FIG. 2. In this case, the cloth tent body is provided with the maximum tensile force and achieves the desired stretch. However, in order to lock the center member 4 to the locking cap 6 when pitching the tent, the ribs 5 coupled to the center member 4 should pass over the desired horizontal position as shown at the solid line of FIG. 2. The cloth tent body is thus not provided with the desired tensile force even when fully pitched. In this regard, the foldable tent of FIG. 2 does not achieve the desired stretch of the cloth tent body when pitched. There is thus formed space between the tent body and the pipe frames. Since the cloth tent body does not have the desired stretch as described above, it will flutter in the wind. When pushing the release button 7 to strike the tent, the user should push or handle the button 7 with his hand fully stretched. However, the user can not exert all his strength with his hand fully stretched as described above so that the pitched tent should be provided with deficient stretch which allows the tent to be struck with the deficient user's strength caused by the fully stretched hand. Another problem of with the foldable tent of FIG. 2 resides in the fact in that the tent size must be limited so that the fully stretched user's hand can reach the locking cap 6 of the pitched tent in order to push or handle the release button 7.

SUMMARY OF THE INVENTION

It is, therefore, an object of the present invention to provide a foldable tent in which the aforementioned problems of the conventional foldable tents can be overcome and which achieves the desired stretch of the cloth tent body when fully pitched.

It is another object of the present invention to provide a foldable tent which is easily pitched and struck regardless of tent size.

It is still another object of the present invention to provide a foldable tent wherein the pipe frames can be easily repaired when they are damaged by long time use.

In order to accomplish the above objects, a foldable tent in accordance with the present invention comprises: a cloth tent body; a plurality of foldable pipe frames coupled to each other at their inside ends and extended so as to pitch the tent, each the pipe frame comprising a plurality of pipes pivotally connected to each other by a plurality of joints; a cylindrical center member coupled to all the inside ends of the pipe frames at its top end, the center member including a top cylinder and a bottom cylinder, the top cylinder being coupled to the pipe frames and having a through hole and the bottom cylinder being detachably coupled to the bottom end of the top cylinder; a cylindrical slider movably fitted over the center member such that it slides along the center member, the slider having a notch on its inner surface; an elastic locking member mounted in the top cylinder of the center member for locking the slider, the locking member having a locking projection elastically penetrating the through hole of the top cylinder so as to snap into the notch of the slider and to retain the pitched state of the tent; means for releasing the locking projection of the locking member from the notch of the slider for folding the pipe frames, the releasing means being received in the bottom cylinder; and a plurality of ribs, each rib being hinged to a corresponding pipe frame and the slider at its opposed ends such that an angle formed between it and the top cylinder when pitching the tent is less than 90°.

BRIEF DESCRIPTION OF THE DRAWINGS

The above objects, features and other advantages of the present invention will be more clearly understood from the following detailed description taken in conjunction with the accompanying drawings, in which:

FIG. 8A sectional view of a center member of a tent framework in accordance with another embodiment of the present invention;

FIG. 8B is an enlarged side view of the circled section B of FIG. 8A.

DESCRIPTION OF THE PREFERRED EMBODIMENTS

Figure 1:
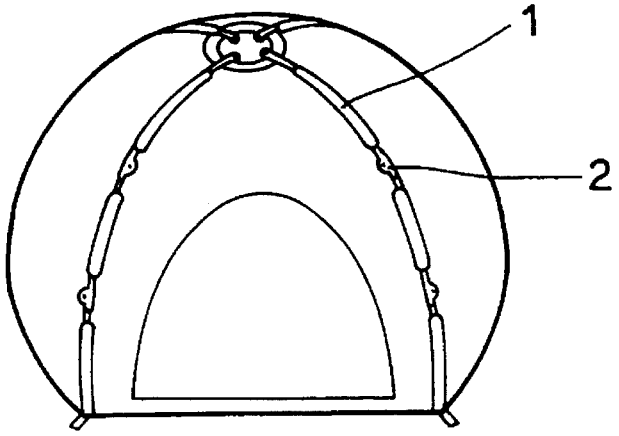
FIG. 1 (PRIOR ART)
FIG 1 is a perspective view of a pitched foldable tent in accordance with one embodiment of the prior art.
Figure 2:
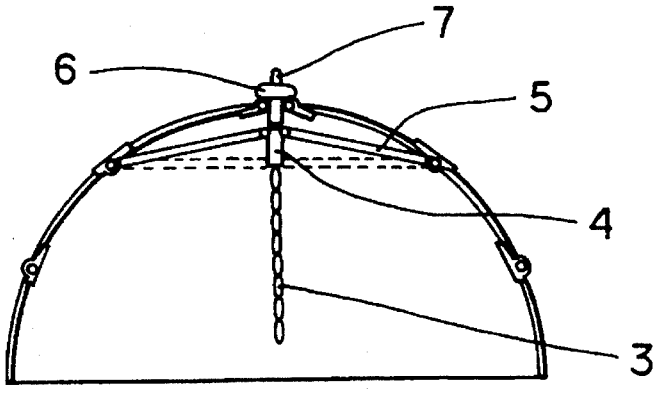
FIG. 2 (PRIOR ART)
FIG. 2 is a side view of the framework of a pitched foldable tent in accordance with another embodiment of the prior art.
Figure 3:
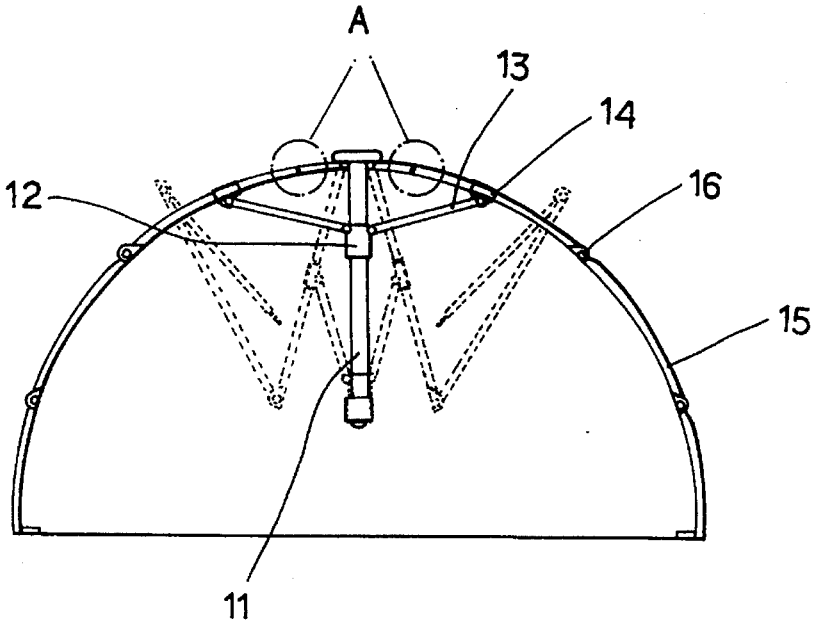
FIG. 3 a side sectional view of the framework of a pitched foldable tent in accordance with a primary embodiment of the present invention.

With reference to FIG. 3, there is shown in a side sectional view a framework of a pitched foldable tent in accordance with a primary embodiment of the present invention. In the foldable tent of the primary embodiment, the foldable ribs are designated by the numeral 13. Each of the foldable ribs 13 is pined to a slider 12 at one end thereof. The other end of each foldable rib 13 is pined to a corresponding rib fixture 14 fixed to a top section of a pipe frame 15. The slider 12 is movably fitted over a cylindrical center member 11 such that it is vertically slidable along the center member 11. As shown at the solid line of this drawing, the slider 12 ascends along the center member 11 and is locked to a top section of the center member 11 as will be described hereinafter, thus firmly retaining the pitched state of the tent. When striking the tent or folding the framework of the tent, the slider 12 is separated from the top section of the center member 11 and descends along the center member 11. The slider 12 in turn is placed about the bottom section of the center member as will be described hereinafter. The folded pipe frame 15 is shown by the dotted line of FIG. 3.

Figure 4:
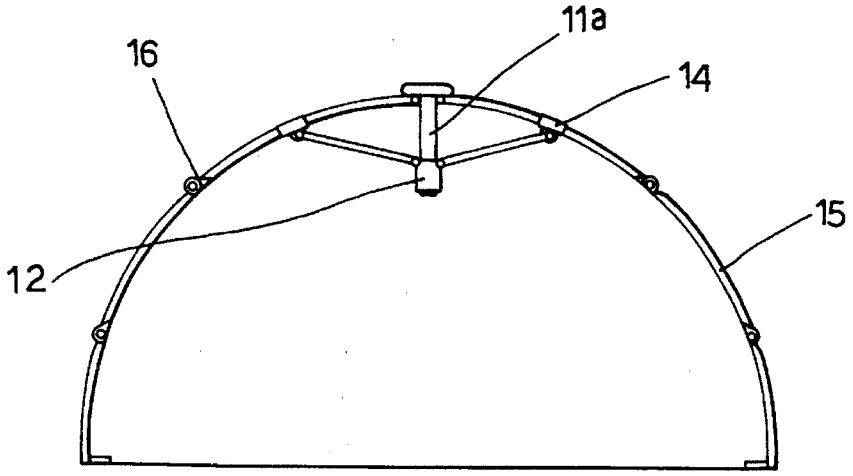
FIG. 4 is a side view of the framework of FIG. 3 in which a bottom cylinder is separated and removed from a center member.

FIG. 4 is a side view of the framework of FIG. 3 in which the bottom section of the center member is separated and removed from the top section of the center member. The above separation of the bottom section is carried out do prevent the bottom section from obstructing the space in the pitched tent.

Figure 5:
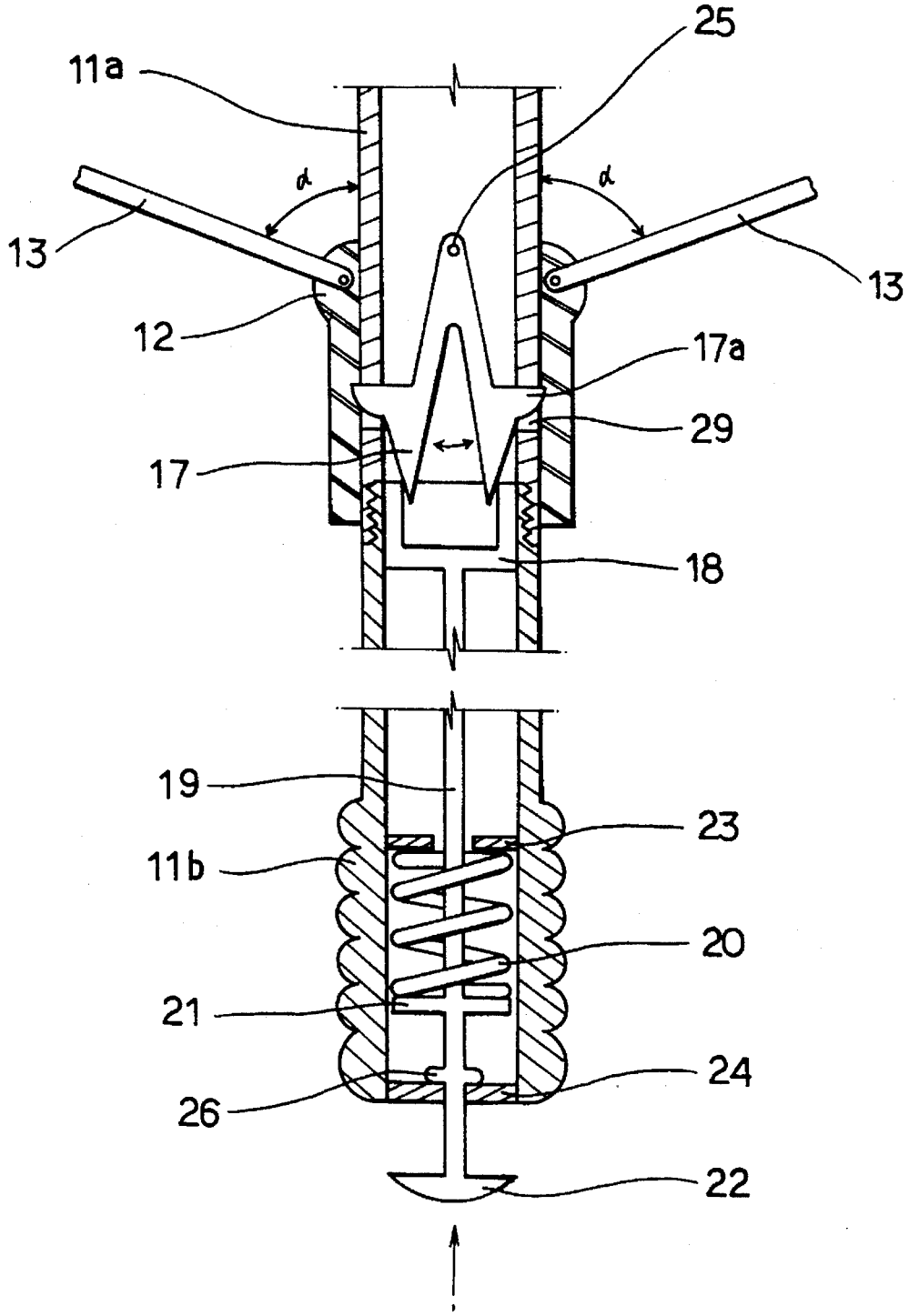
FIG. 5 is an enlarged sectional view showing construction of the center member and a slider of the framework of FIG. 2, the slider being locked to a top cylinder of the center member.
Figure 6:
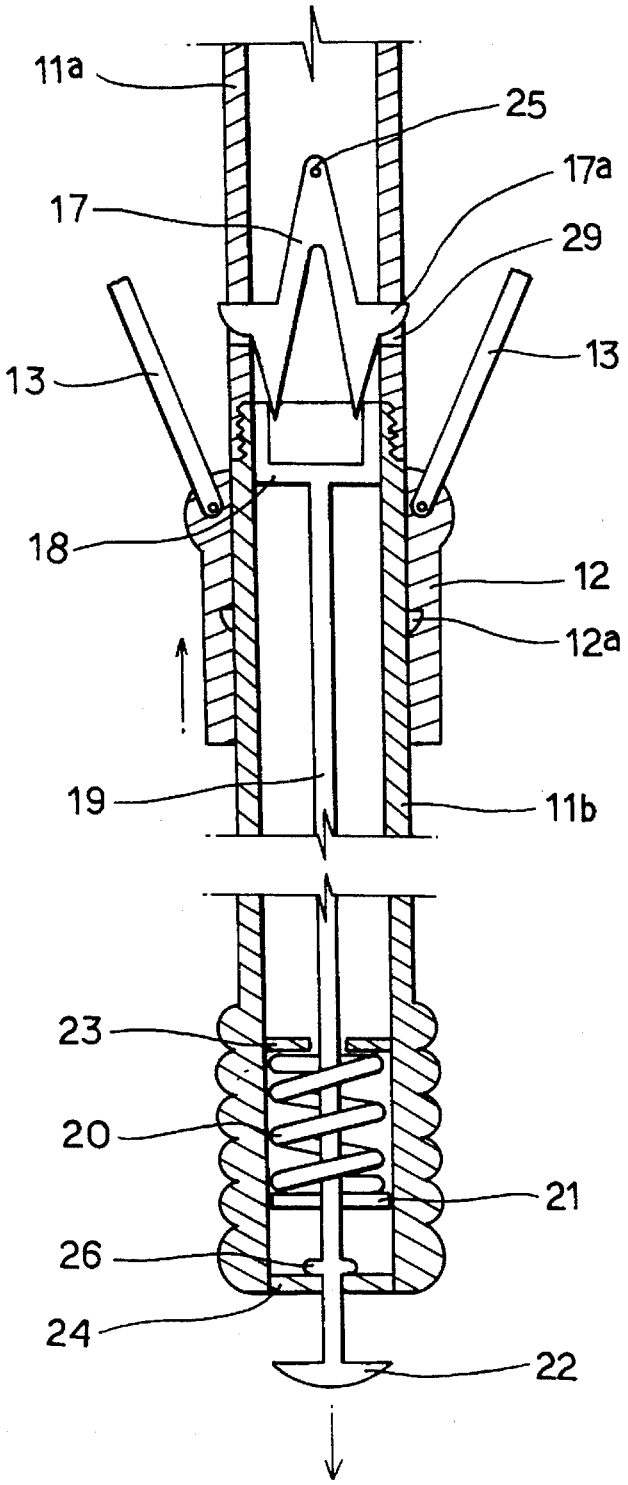
FIG. 6 is a view corresponding to FIG. 5, but showing the slider being serrated from the top cylinder prior to its descending and in turn placed about the bottom cylinder.

The relative position of the slider 12 and the center member 11 are represented in detail in FIGS. 5 and 6.

As shown in FIGS. 5 and 6, the cylindrical center member 11 comprises the top section or a top cylinder 11*a* and the bottom section or bottom cylinder 11*b*. The top and bottom cylinders 11*a* and 11*b* of the center member 11 are detachably coupled to each other by screw type coupling. In the top cylinder 11*a*, an elastic locking member 17 having a pair of projections 17*a* is pined to the inner surface of the top cylinder 11*a* by a pin 25 such that its position with respect to the top cylinder 11*a* is fixed. The reversed V-shaped locking member 17 is made of an elastic material and biased outward at its opposed blades as shown at the arrow of FIG. 5 due to its intrinsic elasticity. Since the blades of the locking member 17 are elastically biased outward, the projections 17*a* of the blades of the locking member 17 penetrate through opposing holes 29 of the top cylinder 11*a* so as to extend to the outside of the cylinder 11*a*. The bottom cylinder 11*b* receives therein a cylindrical piston 18, a connecting rod 19 coupled to the piston 18 and a spring compression plate 21 fixed to the connecting rod 19. The bottom cylinder 11*b* further receives therein a connection rod stop member or a coil spring 20 for stopping the descending movement of the connection rod 19. The free end of the connecting rod 19, which extends to the outside of the bottom cylinder 11*b*, is provided with a release button 22. The lower end of the bottom cylinder 11*b* is closed by a bottom plate 24. The coil spring 20 is placed over the connection rod 19 between a spring stop plate 23 and the spring compression plate 21 in the bottom cylinder 11*b*. As the bottom cylinder shows a circular profile when cross sectioned, the spring stop plate 23, the spring compression plate 21, the coil spring 20 and the release button 22 also have circular profiles. In order to receive the connection rod 19, the bottom plate 24 has a center through hole. The detachable coupling of the top cylinder 11*a* to the bottom cylinder 11*b* is achieved by the screw type fitting of the inner threaded end of the top cylinder 11*a* to the outer threaded end of the bottom cylinder 11*b*. The slider 12 is provided on its inner surface with a pair of notches 12*a* for elastically receiving the projections 17*a* of the blades of the locking member 17. The slider 12 is movably fitted over the center member 11 comprising the top cylinder 11*a* and the bottom cylinder 11*b*. The slider 12 thus vertically slidably along the center member 11. The connection rod 19 is provided with a stopper 26 on its lower section for limiting the descending distance of the connection rod 19.

Each of the foldable ribs 13 is pined to the top section of the slider 12 at one end thereof. The other end of each foldable rib 13 is pined to the corresponding rib fixture 14 of the top section of the pipe frame 15 as shown in FIGS. 3 and 4. Here, the foldable ribs 13 are pined to the top cylinder 11*a* such that the angle a formed between each rib 13 and the outer surface of the top cylinder 11*a* when pitching the foldable tent is less than 90° as shown in FIG. 5.

Turning to FIGS. 8A and 8B, there is shown a center member of a tent framework in accordance with another embodiment of the present invention. In this embodiment, one end of the connection rod 19 is hinged to the cylindrical piston 18 by a pin 31. The other end of the connection rod 19 is hinged to a link 34 by a pin.

The opposed ends of the link 34 having a slot are hinged to the other end of the connection rod 19 and one end of a release lever 32, respectively, such that it is moved as shown at the arrows of FIG. 8A. The one end of the release lever penetrates a side through hole 37 formed in the lower section of the bottom cylinder 11*b* and in turn is hinged to the link 34. The other end of the release lever 34 is hinged to the side wall of the bottom cylinder 11*b*. In order to provide a restoring force for the release lever 32, a compression coil spring 35 is placed between the outer surface of the bottom cylinder 11*b* and the release lever 32.

Figure 9:
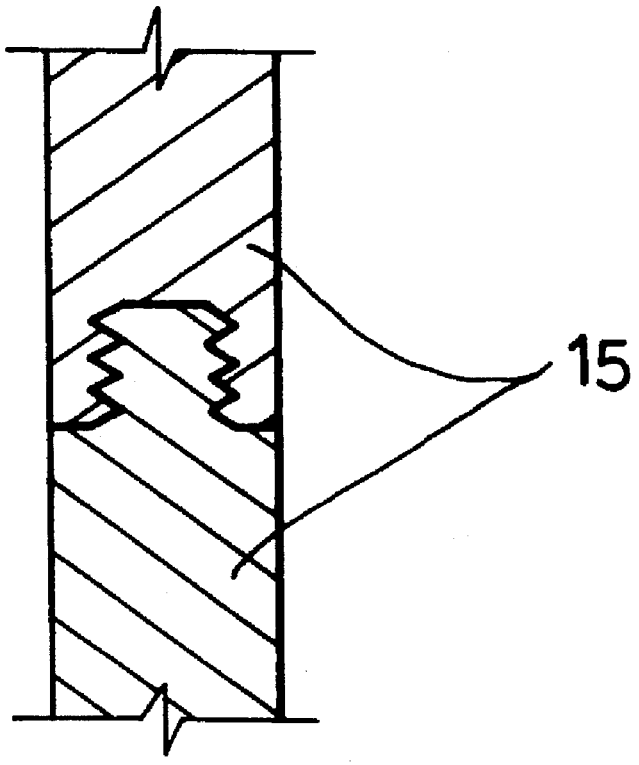
FIG. 9 is an enlarged sectional view of the circled section A of FIG. 3.

FIG. 9 shows a screw type coupling of the frame 15 in accordance with the present invention. In this case, the frame 15 can be disassembled.

Hereinbelow, the operational effect of the top cylinder 11*a*, the bottom cylinder 11*b* and the slider 12 will be given.

In order to pitch the foldable tent, the slider 12 is manually pushed up as shown at the arrow of FIG. 6 while tightly gripping the bottom cylinder 11*b* of the center member 11. The ascending of the slider 12 along the center member 11 is continued until the projections 17*a* of the elastic locking member 17 snap into the notches 12*a* of the slider 12. When the projections 17*a* snap into the notches 12*a* of the slider 12, the slider 12 is locked to the top cylinder 11*a* as shown in FIG. 5, which and finishes the pitching of the foldable tent.

Here, in order to maximize the stretch of the cloth tent body, the foldable ribs 13 are pined to the top cylinder 11*a* such that the angle a formed between each rib 13 and the outer surface of the top cylinder 11*a* when pitching the foldable tent is less than 90° as shown in FIG. 5.

Figure 7:
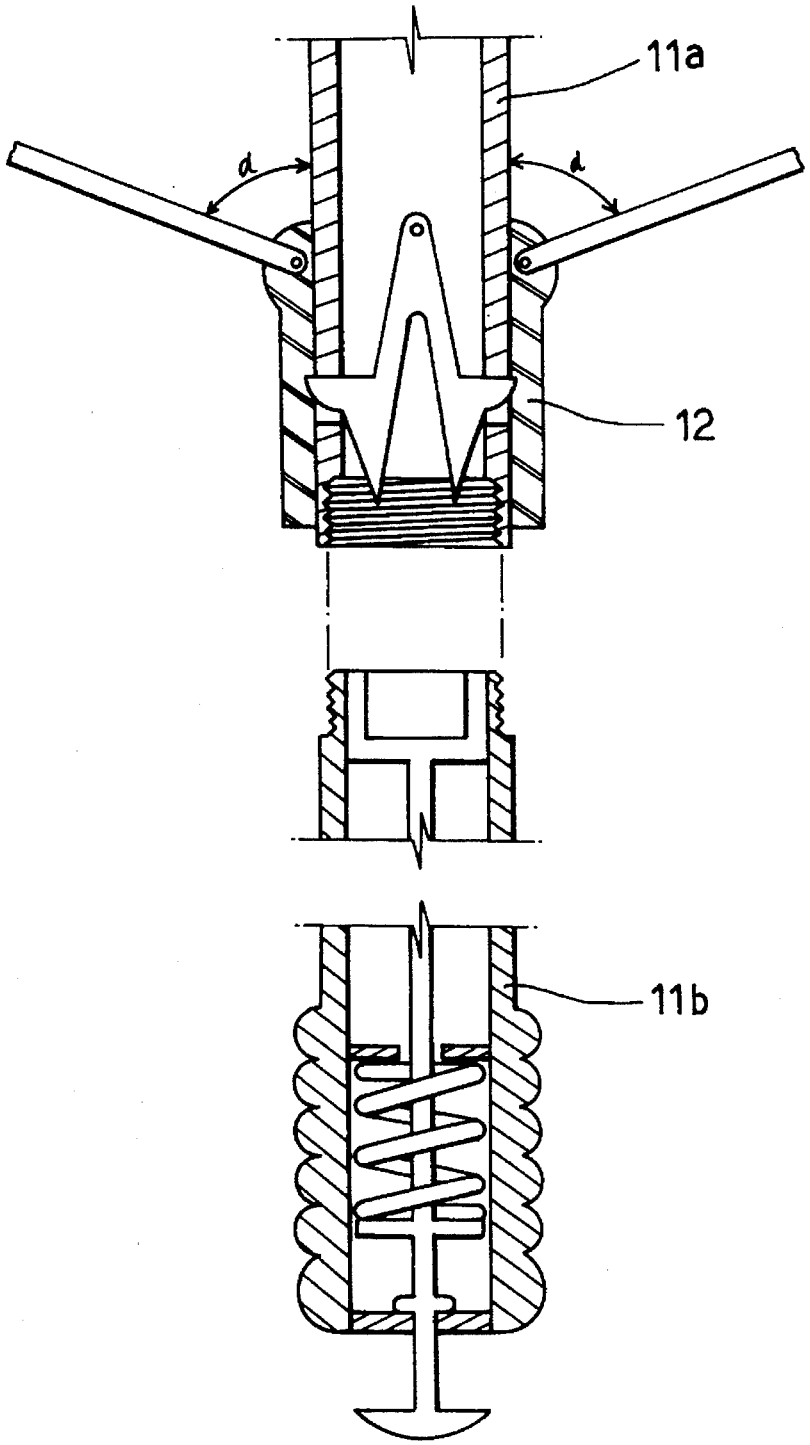
FIG. 7 sectional view showing the top cylinder and the bottom cylinder of the framework of FIG. 2 separated from each other.

When the bottom cylinder 11*b* remains in the tent after finishing the pitching of the tent, it may cause substantial inconvenience in the use of the pitched tent area such as causing a collision with the user head. In order to prevent the inconvenience caused by the bottom cylinder 11*b*, the bottom cylinder 11*b* is separated and removed from the top cylinder 11*a* as shown in FIG. 7. The foldable tent with the bottom cylinder 11*b* separated and removed from the top cylinder 11*a* in practical use, is shown in FIG. 4.

In order to strike the foldable tent or to fold the framework of the tent, the bottom cylinder 11*b* is coupled to the top cylinder by the screw type fitting as shown in FIG. 5. The release button 22 is, thereafter, pushed up so that the connection rod 19 is moved up while compressing the compression coil spring 20 by the spring compression plate 21. As a result of the upward movement of the connection rod 19, the cylindrical piston 18 is moved upward so as to bias inward the blades of the elastic locking member 17. The diverged elastic blades of the reversed V-shaped locking member 17 are thus puckered so as to free the projections 17*a* from the notches 12*a* of the slider 12 and retracted into the through holes 29 of the top cylinder 11*a*. The slider 12 can thus slidably descends along the top cylinder 11*a* due to its own weight and beyond the top cylinder 11*a* as shown in FIG. 6. Thereafter, the pushing force applied to the release button 22 is removed from the button 22 so that the connecting rod 19 elastically descends due to the restoring force of the compression coil spring 20 until the stopper 26 of the rod 19 comes into contact with the inner surface of the bottom plate 24 of the bottom cylinder 11*b*. As a result of the above descending movement of the connecting rod 19, the cylindrical piston 18 releases the elastic locking member 17 so that the blades of the member 17 are elastically opened. The projections 17*a* of the locking member 17 thus penetrates the through holes 29 of the top cylinder 11*a* so as to be exposed to the outside of the top cylinder 11*a*.

In the embodiment of FIG. 8A, the link 34 ascends under the guide of a guide pin 33 and makes both the connecting rod 19 and the cylindrical piston 18 ascending in the center member 11. The projections 17*a* of the locking member 17 is free from the notches 12*a* of the slider 12. As shown in FIG. B which is an enlarged view of the circled section B of FIG. 8A, the top end of the connection rod 19 is hinged to the bottom of the piston 18 so that the link 34 moves under the guide of the guide pin 33 and the cylindrical piston 18 moves vertically and smoothly in the center member 11 even when the piston 18 is eccentric from the connection rod 19.

As described above, the foldable ribs of the tent framework of the present invention are pined to a top cylinder of the center member such that the angle G formed between each rib and the outer surface of the top cylinder when pitching the foldable tent is less than 90°. In this regard, the ribs withstand the force applied from the cloth tent body thereto and increase the stretch of the cloth tent body when pitching the tent, unlike the prior art foldable tents. The framework of the foldable tent of the present invention thus retains the fully stretched cloth tent body. The foldable tent of the invention is easily pitched or struck by simply locking or releasing the slider to or from the center member in the same manner as pitching or folding a conventional umbrella.

When the frame and its joints are partially broken or due to long time use, the broken part of the frame is easily removed from the frame by releasing the screw type coupling section and substituting a new one therefore. In the present regard, the foldable tent of this invention can be used for a long time. Another advantage of the present invention resides in that unlike the prior art foldable tents, the user does not need to stretch his hand so as to push or handle the release button placed on the dome center of the pitched tent in striking the tent or folding the tent framework. In the regard, the foldable tent of this invention is easily pitched and struck regardless of its size and, as a result, as not limited in its size.

Of course, it should be understood that the detachable coupling of the top cylinder to the bottom cylinder of the center member may be achieved by a means other than the aforementioned screw type coupling.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A foldable tent comprising:

a cloth tent body;

a plurality of foldable pipe frames having inside end portions, said pipe frames being coupled to each other at said inside end portions and extended to pitch state of the tent, each of said pipe frame comprising a plurality of pipes jointed to each other by a plurality of joints;

a cylindrical center member having a top and a bottom end, said cylindrical center member being coupled to all of said inside end portions of said pipe frame at said top end, said center member including a top cylinder and a bottom cylinder, said top cylinder being coupled to said pipe frames and having a through hole and said bottom cylinder being detachably coupled to said bottom end of said top cylinder;

a cylindrical slider, slidably fitted over said center member, said slider having an inner surface provided with a notch;

an elastic locking member mounted in said top cylinder of the center member for locking said slider, said locking member having a locking projection elastically penetrating said through hole of the top cylinder so as to snap into said notch of the slider and to retain said pitched state of the tent;

means for releasing said locking projection of the locking member from said notch of the slider for folding said pipe frames, said releasing means being received in said bottom cylinder; and a plurality of ribs having opposite end portions, each of said ribs being hinged to a corresponding pipe frame and said slider at said opposite end portions, respectively, such that an angle formed between said ribs and said top cylinder when the tent is in a pitched state is less than 90°.

2. The foldable tent according to claim 1, wherein said releasing means comprises:

a cylindrical piston movably received in said center member for releasing said locking projection of the locking member from said notch of the slider, said cylindrical piston having a bottom end portion;

a spring stop plate fixedly mounted in said bottom cylinder under said piston;

a connection rod coupled to said bottom end portion of said piston and vertically extending in said bottom cylinder so as to project out of said bottom cylinder;

a spring compression plate mounted on said connection rod under said spring stop plate;

a compression coil spring fitted over said connection rod between said spring stop plate and said spring compression plate for biasing said connection rod downward;

a release button mounted on an end of said connection rod projecting out of said bottom cylinder; and a stopper mounted or a lower section of said connection rod for limiting a descending distance of said connection rod.

3. A foldable tend according to claim 1, wherein said releasing means comprises:

a cylindrical piston movably received in said center member for releasing said locking projection of the locking member from said notch of the slider;

a connection rod hinged to the bottom end portion of said piston by a pin and vertically extending in said bottom cylinder;

a release lever hinged to an outer side surface of said bottom cylinder at one end thereof and received in said bottom cylinder at an other end thereof;

a spring placed between said outer side surface of the bottom cylinder and said release lever for biasing the release lever;

a link hinged to bottom end of said connection rod and to an other end of said release lever at opposed ends thereof, said link having a guide slot; and a guide pin mounted in said bottom cylinder and received in said slot of the link so as to guide the link motion of said link.

4. The foldable tent according to claim 1, wherein the detachable coupling of said top cylinder to the bottom cylinder is achieved by screw type coupling.

5. A foldable tent comprising:

a hollow cylindrical center member having a top cylindrical section which is detachably attached to a bottom cylindrical section;

a slider member slidably mounted to the cylindrical center member;

a plurality of pipe frames, each containing a plurality of pipes jointed together;

a plurality of rib members hinged at one end to a corresponding pipe frame and at another end to said slider member, said ribs, when extended, forming an angle of less than 90 degrees with the top cylindrical section;

a locking projection disposed in the top cylindrical section for locking the slider member relative to said cylindrical center member, and means for releasing the locking projection, said releasing means received in the bottom cylindrical section.

6. The foldable tent of claim 5, wherein the top cylindrical section of the center member is provided with an aperture and the slider member is provided with a notch, whereby when the tent is in a pitched position, the locking projection is adapted to extend through said aperture in the center member into engagement with the notch provided in the slider member.

7. The foldable tent of claim 6, wherein the locking projection is biased in slidable engagement with the inside of the center member.

8. The foldable tent of claim 7, wherein the means for releasing the locking projection extends from the bottom cylindrical section into selective engagement with said locking projection, said releasing means being operative to compress the locking projection against its bias thereby enabling the slider means to slide relative to the center member.

9. The foldable tent of claim 8, wherein the means for releasing the locking projection is a piston-connecting rod coaxially disposed in said bottom cylindrical section, said connecting rod extending from the locking member to a position outside the bottom cylindrical section and being biased from active engagement with said locking member, said engagement becoming active by compressing said piston-connecting rod against said bias.

10. The foldable tent of claim 8, wherein the means for releasing the locking projection is a piston-connecting rod coaxially disposed in said bottom cylindrical section, said connecting rod being hinged to said piston and extending to the bottom of said bottom cylindrical section, and a release lever disposed at an outside portion of said bottom cylindrical section, said release lever being linked to a lower end portion of said connecting rod.

* * * * *